US006193150B1

(12) United States Patent
Ariga

(10) Patent No.: US 6,193,150 B1
(45) Date of Patent: Feb. 27, 2001

(54) CABLE GUIDE, DRAWER STRUCTURE AND TERMINAL DEVICE

(75) Inventor: Isao Ariga, Tachikawa (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/388,610

(22) Filed: Sep. 2, 1999

(30) Foreign Application Priority Data

Jan. 22, 1999 (JP) ..... 11-014352

(51) Int. Cl.[7] ..... G07G 1/00

(52) U.S. Cl. ..... 235/7 R; 312/330.1; 312/223.3

(58) Field of Search ..... 235/7 R, 22; 312/117, 312/137, 138.1, 223.1, 223.2, 223.3, 223.6, 330.1, 334.1, 334.7, 334.8, 334.13, 334.16, 334.17, 334.18

(56) References Cited

U.S. PATENT DOCUMENTS 5,339,213 * 8/1994 O'Callaghan ..... 312/330.1

5,897,179 * 4/1999 Wade ..... 312/223.6

* cited by examiner

*Primary Examiner*—Thien M. Le
*Assistant Examiner*—Larry Taylor
(74) *Attorney, Agent, or Firm*—Staas & Halsey LLP

(57) ABSTRACT

A cable guide, drawer and terminal device are provided. The terminal device has a casing. The drawer is moveable between open and closed positions into and out of the casing, respectively. The drawer has a front and a body, the front having a lip extending beyond the body. The cable guide has a guide part attached to the side of the drawer. The guide part has first and second ends. The first end is positioned toward the front of the drawer. The first end extends further beyond the body of the drawer than the second end. The guide part becomes progressively thinner from the first end to the second end so that a cable draped over the drawer is pushed away from the body of the drawer as the drawer is closed. The guide part may have a curved surface portion from the first end to the second end. The guide part may be shaped so that it does not interfere with a member attached to a side surface of the drawer. The guide part may have an attachment portion attached to the side surface of the drawer. In this case, The front of the drawer may extend above the top of the body and the attachment portion may have a notch. The notch may be formed into the attachment portion to extend toward the front of the drawer.

22 Claims, 6 Drawing Sheets

FIG. 1
PRIOR ART
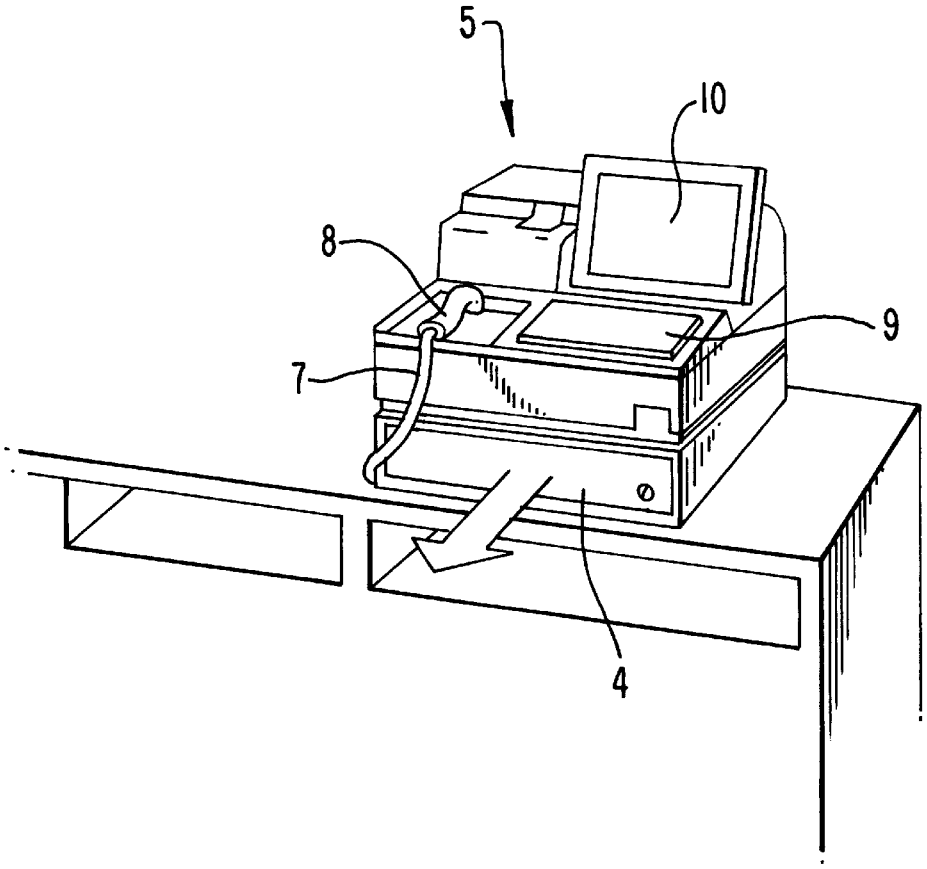
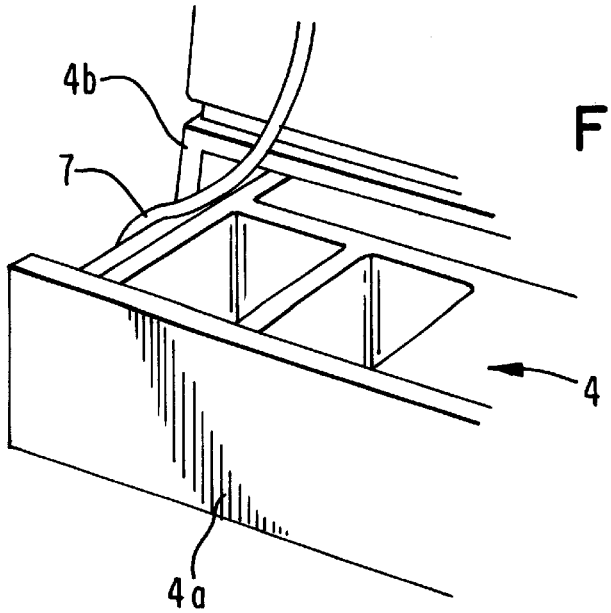
FIG. 2

CABLE GUIDE, DRAWER STRUCTURE AND TERMINAL DEVICE

CROSS-REFERENCE TO RELATED APPLICATIONS

This application is based upon and claims priority of Japanese Patent Application No. 11-14352 filed Jan. 22, 1999, the contents being incorporated herein by reference.

BACKGROUND OF THE INVENTION

1. Field of the Invention

The present invention relates in general to devices that can be attached to drawers. More specifically, the present invention relates to a device which prevent cables and the like from becoming caught in a drawer.

2. Description of the Related Art

In recent years, there have been a large number of point of sale ("POS") terminals/electronic cash registers ("ECRs") to which bar code scanners are attached to read bar codes. Bar code scanners are generally classified as fixed, which may be fixed to the top of a counter, and hand-held, which are manipulated by a store clerk.

Although some hand-held bar code scanners are wireless, transmitting information without wires, the type which is connected to a POS terminal with a cable/wire is more common. The cable transmits bar code signals read from the bar code scanner to the POS terminal, and at the same time, supplies power to the bar code scanner to drive the bar code scanner.

When this type of hand-held bar code scanner is placed on the top of the POS terminal, the cable usually hangs down over the edge of the POS terminal. If the cable hangs down in front of a drawer (perhaps used for holding cash) of the POS terminal, the cable may become caught between the drawer and the body of the POS terminal when the drawer is closed. In this case, it is quite likely that the sheath of the cable or the cable itself will be broken, eventually resulting in a short or open circuit.

In particular, since the drawer of the POS terminal is biased away from the terminal by a strong spring, a certain amount of force must be exerted to close the drawer to oppose the force of the spring. With excessive force, chance of breaking the bar code scanner cable increases.

When the touch scanner cable is broken, it is impossible to read bar codes with the touch scanner. As a result, the product cannot be registered, and the check-out process is delayed when the data is manually entered. In addition, the body (frame and the like) of the POS terminal may be made of metal, and if the body or frame comes into contact with the scanner cable having a broken sheath, current intended to power the bar-code scanner may flow through the POS terminal.

SUMMARY OF THE INVENTION

Accordingly, it is an objective of the present invention to provide a mechanism which prevents a cable from becoming caught in a drawer.

It is a further object of the present invention to avoid damaging a cable draped over a drawer.

It is another object of the present invention to avoid damaging electronic equipment in a casing housing the drawer.

These and other objects are accomplished by providing a cable guide, drawer and terminal device. The terminal device has a casing. The drawer is moveable between open and closed positions into and out of the casing, respectively. The drawer has a front and a body, the front having a lip extending beyond the body. The cable guide has a guide part attached to the side of the drawer. The guide part has first and second ends. The first end is positioned toward the front of the drawer. The first end extends further beyond the body of the drawer than the second end. The guide part becomes progressively thinner from the first end to the second end so that a cable draped over the drawer is pushed away from the body of the drawer as the drawer is closed. The guide part may have a curved surface portion from the first end to the second end.

The guide part may be shaped so that it does not interfere with a member attached to a side surface of the drawer. The guide part may have an attachment portion attached to the side surface of the drawer. In this case, the front of the drawer may extend above the top of the body and the attachment portion may have a notch. The notch may be formed into the attachment portion to extend toward the front of the drawer.

BRIEF DESCRIPTION OF THE DRAWINGS

The invention will be readily understood by reference to the following description of specific embodiments described by way of example only, with reference to the accompanying drawings, wherein:

FIG. 1 is a perspective view of a conventional POS terminal device;

FIG. 2 is a perspective view showing the position of a cable when a drawer of the POS terminal shown in FIG. 1 is left open;

DETAILED DESCRIPTION OF THE PREFERRED EMBODIMENTS

Figure 3C:
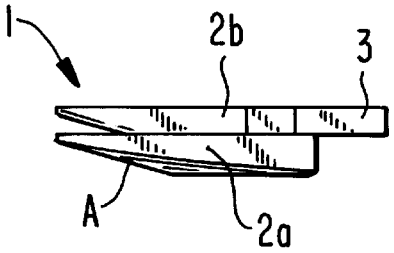
FIG. 3C is a top view of the cable guide of FIG. 3A, according to the present invention.

The present invention will now be described in connection with a POS terminal device having a hand held scanner.

Despite this description, the present invention is not restricted to POS terminal devices and can be used with any drawer. FIG. 1 is a perspective view of a conventional POS terminal device. A POS terminal 5 is set on top of a sales counter in the store and is used at check out, when making calculations for products to be purchased by customers.

The POS terminal is loaded has a bar code scanner 8 (the touch scanner at the center of the diagram) which is used to input product information, keyboard 9, display 10 which is used to display the prices, total cost and names of the products and a printer which prints out receipts. A drawer 4, which is used to hold cash, is located at the bottom of POS terminal 5. This drawer 4 is usually closed to prevent money from being stolen and is configured so that the store clerk can perform calculations and/or press keys and perform other operations which may be required before taking cash from the drawer to give the cash to a customer. The drawer of the device shown in FIG. 1 is biased away from the POS terminal with a comparatively strong spring.

A space to hold touch scanner 8 is provided on the top of POS terminal 5. The space makes it possible to improve the maneuverability when the store clerk uses touch scanner 8. Touch scanner 8 may also be placed on the counter, but since the touch scanner could fall from the counter, stress could be exerted on cable 7. As a result, it is highly likely that the cable 7 will break. To remedy this, the space for holding the touch scanner on top of the POS terminal is recessed. Alternatively, the space may be shielded with a low wall to retain the touch scanner. Thus, placing the touch scanner on top of the POS terminal is effective in preventing the touch scanner from falling. Nevertheless, yet another problem crops up.

Cable 7 is used to connect the POS terminal 5 and the touch scanner 8. This cable 7 transmits the bar code signals read with the touch scanner 8 to POS terminal 5 and at the same time provides power from the POS terminal to the touch scanner 8. When the touch scanner 8 is placed on the top of the POS terminal 5, the cable 7 hangs down as indicated in FIG. 1. The cable 7 is forced to hang down in front of the drawer 4 due to the orientation of the touch scanner 8 on the top of POS terminal 5. In the example shown in FIG. 1, the back part of touch scanner 8 is oriented toward the operator (in front in the diagram) so that cable 7 hangs down directly in front of drawer 4. FIG. 2 is a perspective view showing the position of cable 7 when drawer 4 is left in an open position. As indicated in FIG. 2, when drawer 4 is left open, cable 7 can be caught on the side part of the drawer 4.

When the calculations and cheek out are finished and the store clerk closes the drawer, there is a stepped interval between the front and the side of the drawer so that the cable catches between the front part 4*a* and the body 4*b* of the drawer. In particular, since the drawer of the POS terminal is biased outwardly by a spring, store clerks often close the drawer 4 by exerting force on it. After cable 7 is caught many times between drawer 4 and body 4*b*, the sheath and wires of cable 7 can break.

When the touch scanner cable is broken, signals can no longer be transmitted to POS terminal 5. As a result, bar codes can no longer be read by touch scanner 8. In addition, after the sheath of touch scanner 8 brakes, it is possible that the current which drives the scanner will flow through the drawer 4 and to the POS terminal 5. This could damage any electronic devices in the POS terminal 5. As noted above, it is highly likely that the touch scanner cable, by being caught in the drawer, can damage the POS terminal. Thus, it is necessary to prevent the cable from being caught in the drawer.

One embodiment of the invention addresses these problems with a member, which functions to push the cable toward the outside of the drawer, as the drawer is closed. This member is attached to a side part of the drawer.

Figure 3A:
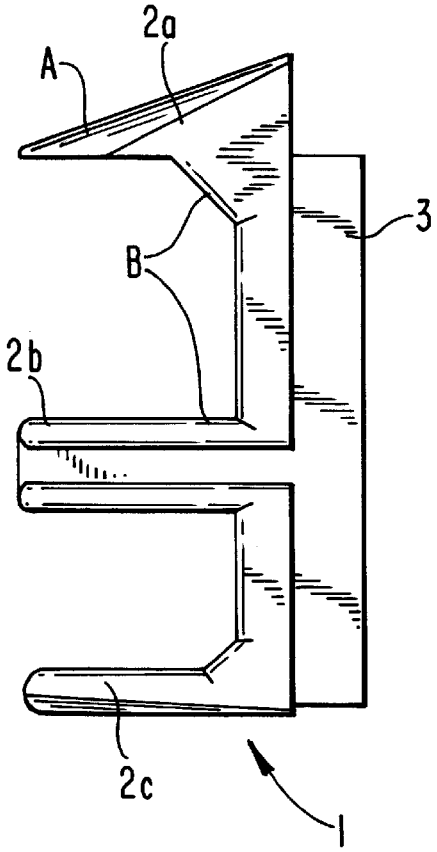
FIG. 3A is a side view of a cable guide according to a first embodiment of the present invention.
Figure 3B:
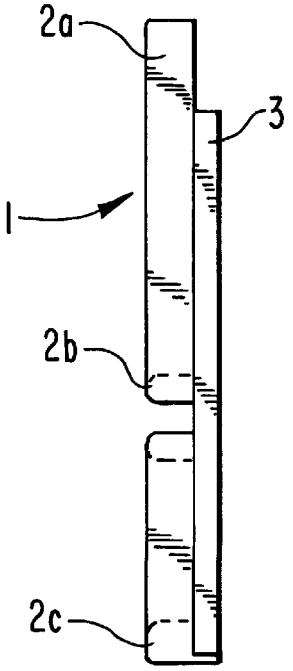
FIG. 3B is a back view of the cable guide of FIG. 3A, according to the present invention.
Figure 4:
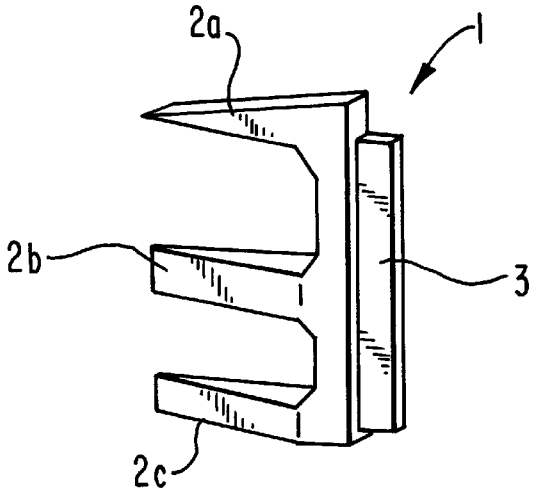
FIG. 4 is a perspective view of a cable guide according to a second embodiment of the present invention.
Figure 5:
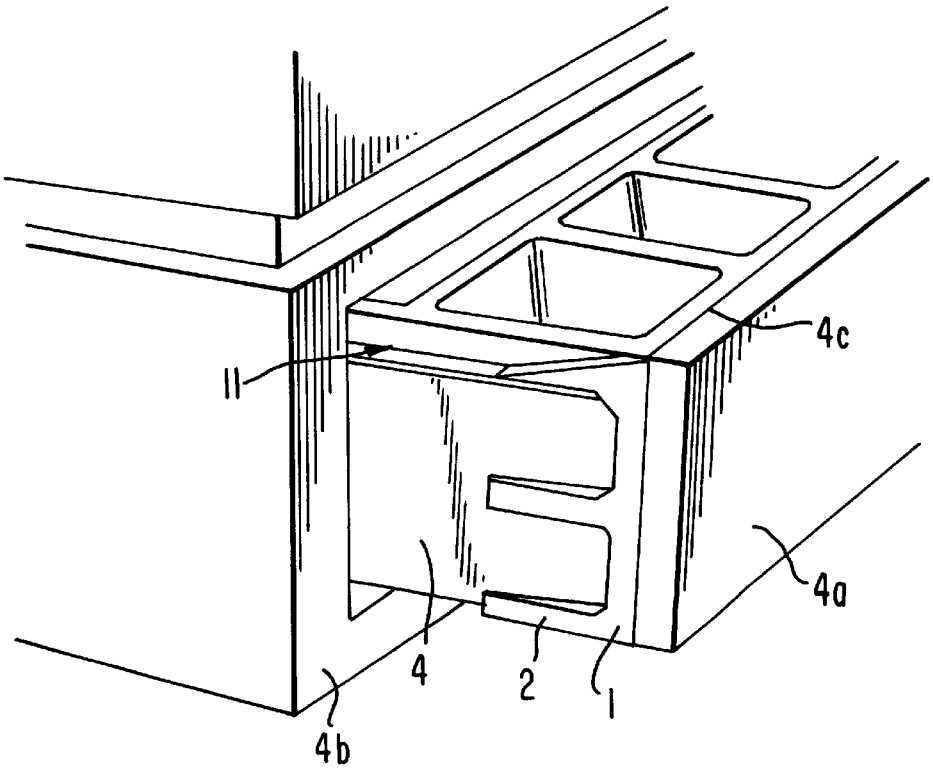
FIG. 5 is a perspective view of a drawer with the cable guide of FIG. 4, attached thereto.

FIG. 3 and FIG. 4 are diagrams of the outside appearance of a member (hereinafter referred to as a "cable guide") which prevents a cable from becoming caught in a drawer. The cable guide is attached to the side of drawer 4. Specifically, FIG. 3A is a side view of the cable guide 1 according to a first embodiment of the present invention. FIG. 3B is a back view of the cable guide 1 (as would be viewed from the right of FIG. 3A). FIG. 3(*c*) is a top view of the cable guide 1 shown in FIG. 3A. FIG. 4 is a perspective view of a cable guide 1 according to a second embodiment of the present invention. FIG. 5 is a perspective view of a drawer 4 with the cable guide 1 of FIG. 4 attached thereto.

The cable guide of these embodiments of the invention is configured as an integral piece, possibly made of a resin. Of course, the cable guide may also be made of sheet metal or other material.

Guide parts 2*a*, 2*b* and 2*c* are formed on the upper level, middle level and lower level, respectively, of the cable guide 1 shown in FIGS. 3 and 4. Note that in the back view of FIG. 3*b*, the middle level 2*b* and lower level 2*c* are shown in dotted lines, as these parts can not be seen from the back of the device.

A clapper part 3, used to plug the cable guide 1 into the front of the drawer 4, is formed on one end of the cable guide 1. The cross-sectional size and shape of the clapper part is made to fit the size and shape of a recess in a front surface 4*a* of the drawer 4. It is shaped to fit a recess because when there is a space between the cable guide 1 and the drawer 4, it is quite likely that the cable 7 will be caught between these parts. If there is no space between the front surface and the side surface of the drawer, it is possible to reduce the likelihood of cable 7 becoming caught in the drawer 4. The cable guide 1 in this embodiment of the invention functions to eliminate any space between the front and side surfaces of the drawer.

It is by no means necessary that the shape and size of the cable guide and the drawer be the same as that shown in the drawings. There may be some difference as long as the cable is prevented from becoming caught in the drawer. For example, when the sheathing of the cable is made from a material which is easily caught in a space, there should be no space. However, when the material presents no problem, there may be a slight gap. In FIG. 5 there is no gap or space between the front part 4*a* of drawer 4 and the cable guide 1.

Guides 2*a* through 2*c* for the upper, middle and lower levels, respectively, are shaped so that they become progressively thinner (the thickness becomes narrower) towards the tip. This enables the cable 7 which has become caught on the part of drawer 4 to be pushed outside the drawer 4.

Figure 12:
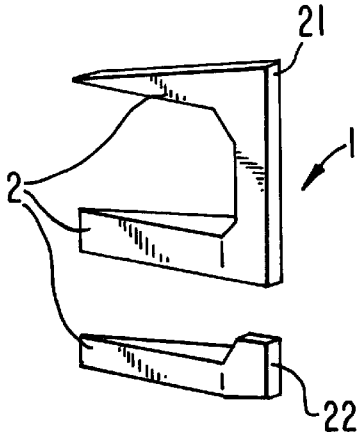
FIG. 12 is a diagram indicating example of cable guide configured of multiple parts.

The edge part of the cable guide in this practical embodiment of the invention may be chamfered so that it is completely curved so as to eliminate, as much as possible, any factors which would cause the cable to become caught. For example, as can be seen from the cross-section of the guide part in FIG. 3, the guide part (particularly the middle level 2*b* and lower level 2*c*) has a nearly semicircular shape when seen in the cross-section. In addition, part A of the guide part 2*a* of the uppermost level 2*a* is also chamfered so that the cable does not become caught in the middle when sliding on the cable guide. Part B of the cable guide 1 is also chamfered. Note that the device shown in FIGS. 4, 5 and 12 are not shown with chamfering. However, chamfering could also be used with these devices.

Figure 6:
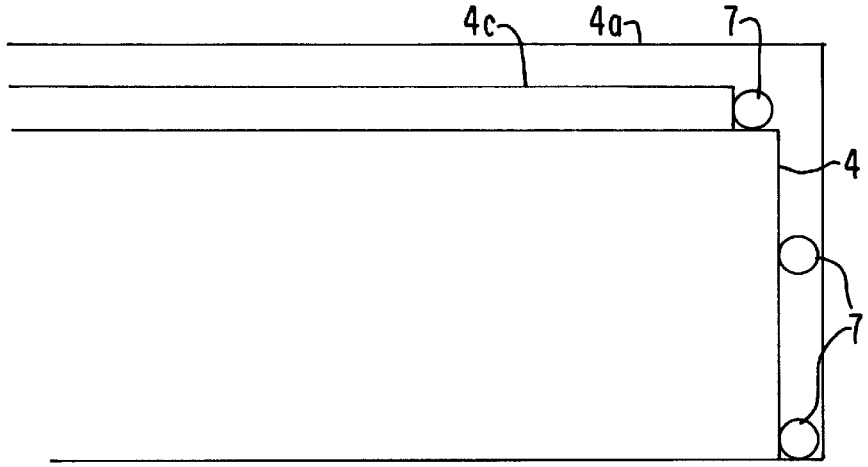
FIG. 6 PRIOR ART
FIG. 6 is a diagram of a cross-section of drawer when there is no cable guide.

Next, we shall explain how the cable guide operates. FIG. 6 is a diagram of a cross-section of drawer 4 when there is no cable guide 1. In the figure, the circles schematically represent cable 7. Here, when drawer 4 is closed, cable 7 becomes caught at the front surface 4*a* of the drawer.

Figure 7:
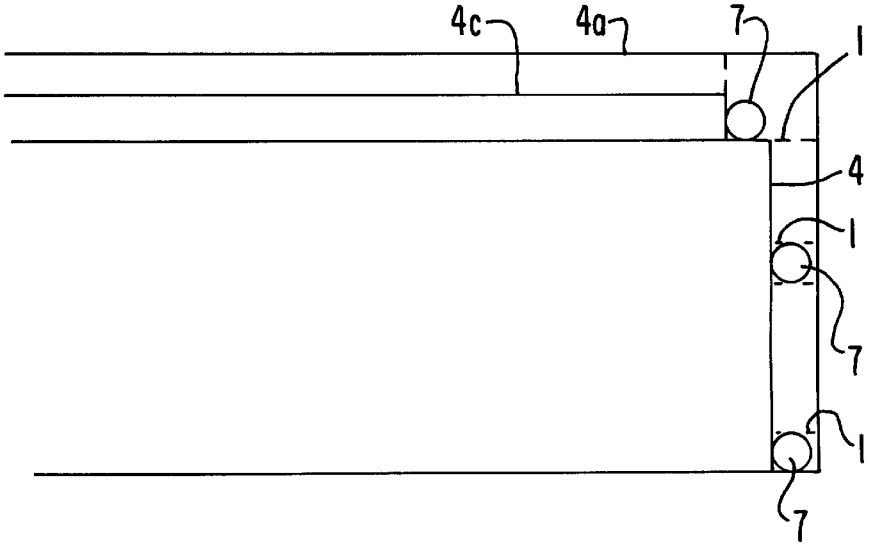
FIG. 7 is a cross-sectional view of a drawer with a cable guide attached thereto, taken through a plane parallel to a front surface of the drawer at a point distant from the front surface of the drawer.

FIG. 7 is a cross-sectional view of a drawer 4 with a cable guide 1 attached thereto, taken through a plane parallel to a front surface 4*a* of the drawer 4 at a point distant from the front surface of the drawer 4.

Figure 8:
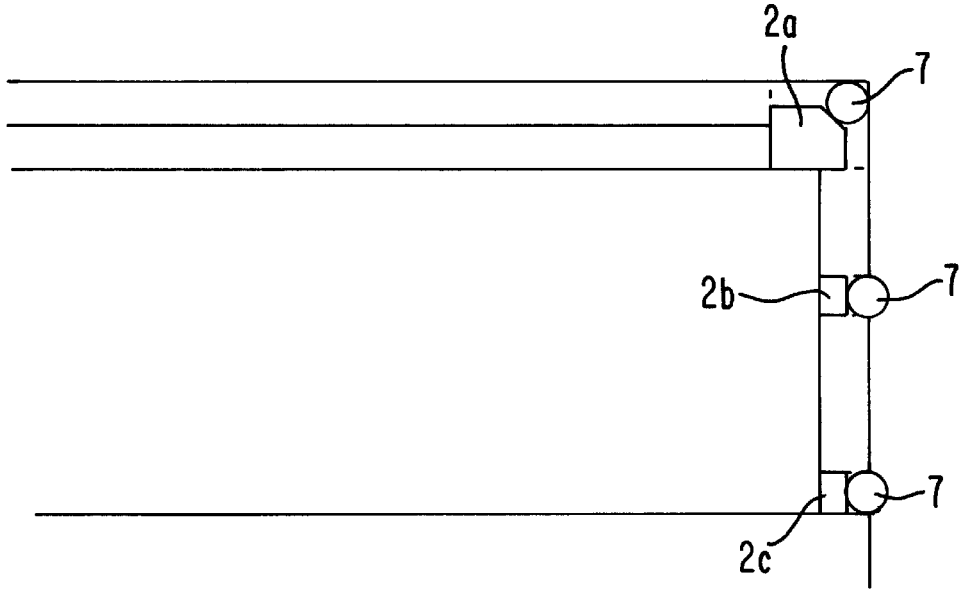
FIG. 8 is a cross-sectional view of the drawer shown in FIG. 7, taken through a plane parallel to a front surface of the drawer at a point approximately midway through the cable guide.

FIG. 8 is a cross-sectional view of a drawer 4 with a cable guide 1 attached thereto, taken through a plane parallel to a front surface 4*a* of the drawer 4 at a point approximately midway through the cable guide 1.

Figure 9:
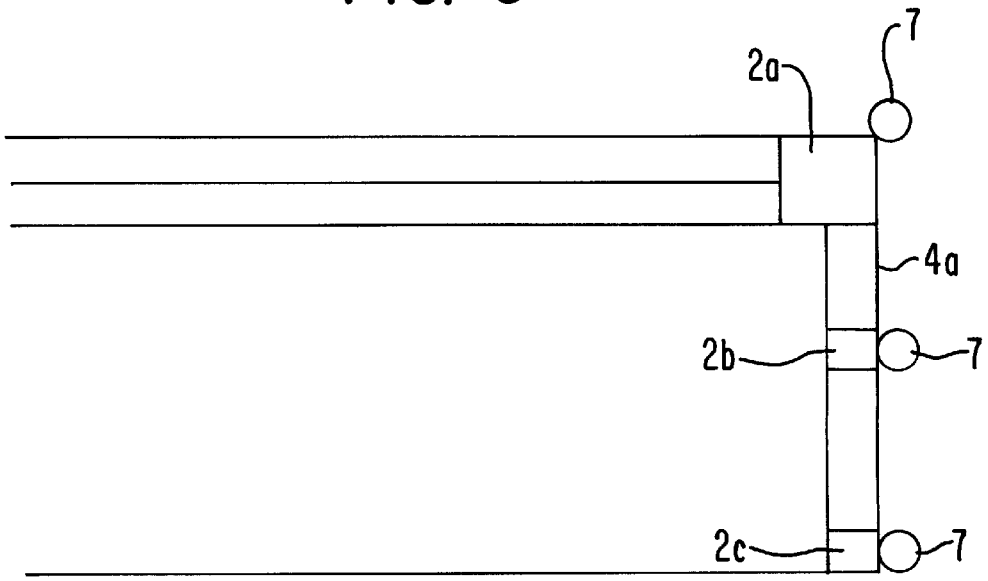
FIG. 9 is a cross-sectional view of the drawer shown in FIG. 7, taken through a plane parallel to a front surface of the drawer at a point adjacent to the front surface of the drawer.

FIG. 9 is a cross-sectional view of a drawer 4 with a cable guide 1 attached thereto, taken through a plane parallel to a front surface 4*a* of the drawer 4 at a point adjacent to the front surface 4*a* of the drawer.

The shape indicated in FIG. 7 is virtually the same as that in FIG. 6 with the only difference being that the cable guide 1 is indicated by a dotted line. Of course, the dotted lines shown in FIGS. 7 and 8 would not be visible. The dotted lines are illustrated to show the increasing size of the cable guide 1 towards the front of the drawer 4. When the cable guide 1 is attached to the drawer 4, inclined surfaces are effectively formed on the drawer 4. As a result, the cable 7 is progressively pushed away from the drawer 4 along the guide parts 2*a*–2*c* of cable guide 1 as drawer 4 is closed, as indicated in FIG. 8 and FIG. 9.

Further, a tray 4*c* used to hold cash is contained inside the drawer 4, as indicated in FIG. 5. However, a space 11 is created between this tray 4*c* and the top of the drawer 4. The upper level guide part 2*a* on cable guide 1 in this practical embodiment fills this space 11. That is, upper level guide part 2*a* overhangs inside the drawer by comparison with the middle level guide part 2*b* and the lower level guide part 2*c*.

The function of the upper, middle and lower level guide parts 2*a* through 2*c* will now be described. A rail and roller are provided on drawer 4 so that drawer 4 can be opened and closed smoothly. If the rail and/or roller interfere with the cable guide when the drawer is opened and closed (particularly when closed), the drawer could no longer be closed because the cable guide 1 would block the path. In particular, if the cable guide 1 is attached to a preexisting drawer 4 from behind, it is highly likely that the cable guide 1 would contact the preexisting roller if the separate levels were not provided. The embodiments of the cable guide 1 described thus far take this into consideration and are formed with notches at the positions where the roller could be contact.

Figure 10:
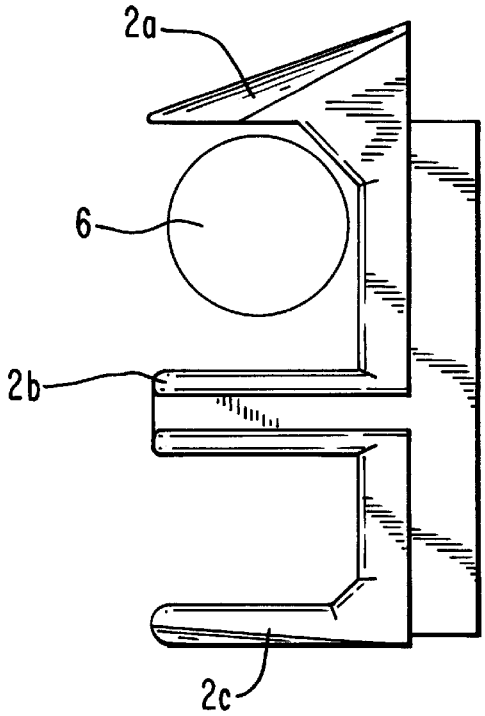
FIG. 10 is a side view of the cable guide of FIG. 3A and a roller, illustrating the relative positions of the cable guide and the roller when the drawer is closed.

FIG. 10 is a side view of a cable guide and a roller 6, illustrating the relative positions of the cable guide 1 and the roller 6 when the drawer is closed. In the example shown in FIG. 10, the roller 6 is set between guide part 2*a* on the upper level and guide part 2*b* on the middle level. Thus, it can be seen that when the drawer is closed, if part of the cable guide 1 were not notched, the roller 6 would interfere with the cable guide 1. It should be clear that if the roller is positioned further back from the front surface than is indicated in FIG. 10, the cable guide 1 may not interfere with the roller 6 and the rail. In this case, the cable guide 1 may be formed without notches, so that the entire side surface of cable guide 1 forms a single guide part 2, as indicated in FIG. 11.

In the above-described embodiment of the invention, the cable guide was described as being attached to a preexisting drawer, from the back. However, the cable guide may also be shaped so that it forms an integral piece with the drawer. It is relatively easy to form a drawer with the cable guide as an integral piece, particularly when the drawer is made of a resinous material. Further, there is virtually no difference in outside appearance of the drawer, as compared with FIG. 5.

When designing the cable guide as an integral part of a drawer, the attachment position for the roller used for opening and closing the drawer can be varied to a certain extent. Thus, it is relatively easy to preclude the roller from contacting a cable guide regardless of the shape of the cable guide. In this ease, a cable guide with no notches as indicated in FIG. 11 can be used.

Figure 11:
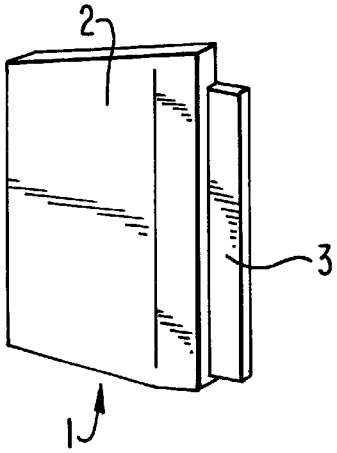
FIG. 11 is a perspective view of an unnotched cable guide.

The cable guide indicated in FIG. 11 should ideally be used to eliminate any possible catching of the cable. However, the cable can be sufficiently prevented from becoming caught even with the cable guide indicated in FIG. 3 and FIG. 4. Particularly, since the FIG. 3 and FIG. 4 devices are provided with a middle level guide part 2*b*, this guide part can push a cable away from the drawer even if the cable fits into the side part of the drawer (FIG. 7 through FIG. 9).

According to a preferred embodiment of the present invention, the cable which hangs down in front of the drawer can be pushed away from the drawer 4 when the drawer is closed to clear a front surface 4*a* of the drawer 4. This eliminates problems occurring when the cable becomes caught. Thus, the drawer can be closed without the operator being preoccupied with the cable becoming caught in the drawer 4 so that check out operations can be carried out more efficiently and smoothly.

The cable guide 1 can be made of a resinous material or other materials and it is not particularly expensive. Therefore, it is extremely easy and relatively economical to attach a cable guide 1 to a drawer 4 from the rear of the drawer 4 without any other countermeasures being needed for preventing the cable from becoming caught, as indicated in the practical embodiment of the invention. The cable guide 1 can be installed by plugging a clapper part 3 into the rear of a drawer 4, or it can be attached to the side of the drawer using double-sided tape and/or screws or the like. Thus, there is no need to purchase drawers with built-in cable countermeasures. Hence, the device is economical.

Naturally, it would have been possible to create a drawer with a cable guide already attached thereto. People who purchase a completely new drawer may purchase a drawer having the anti-catching cable guide already installed. Alternatively, a regular drawer, and a cable guide may be purchased separately. As stated above, the drawer with an integral cable guide can be easily manufactured using a resin material.

The shape and the size of the cable guide naturally may be varied at will in accordance with the type of drawer and cable and other design considerations. However, the cable guide should not interfere with the opening and closing of the drawer.

In the above-mentioned practical embodiment of the invention, a cable guide is attached to only one side of the drawer. However, the cable guide may be attached to a side opposite to that shown or may be attached to both sides of the drawer. In addition, in the preceding description the term "side surface" of the drawer was used to distinguish it from a front surface. The term "side surface" is meant to include a top surface as well as a bottom surface of the drawer. If the cable could become caught on the upper part of the drawer, a cable guide could be attached to the top surface of the drawer as long as removing the contents from the drawer and the opening and closing of the drawer are not impeded.

In addition, in the above-description, the cable guide is describe as being a single piece. However, if there are problems with the structure of the drawer, the cable guide can certainly be formed of multiple pieces. FIG. 12 is a perspective view of a multi-piece cable guide. As can be seen, the cable guide 1 has first part 21 and a second part 22.

The shape of the aforementioned guide part is not particularly restricted to the shape shown and described. For example, the thickness of the guide part is shown and described as changing continuously. Nevertheless, this may not be necessary if the cable cannot become caught.

There is no reason why the cable guide should be restricted to the POS terminal environment described above. The invention can be used with any device as long as a cable and other parts run the risk of becoming caught. For example, if a cable guide is attached to a drawer of a regular office desk, the cable of a mouse attached to a computer and telephone cords can be prevented from becoming caught. Thus, there are wide applications for the cable guide of the present invention.

While the invention has been described in connection with the preferred embodiments, it will be understood that modifications within the principles outlined above will be evident to those skilled in the art. Thus, the invention is not limited to the preferred embodiments, but is intended to encompass such modifications.

What is claimed is:

1. A cable guide for attachment to a drawer having a front and a body, the front having a lip extending beyond the body, the cable guide comprising a guide part having first and second ends, the first end being toward the front of the drawer, and the first end extending further beyond the body of the drawer than the second end, the guide part becoming progressively thinner from the first end to the second end so that a cable draped over the drawer is pushed away from the body of the drawer as the drawer is closed.

2. A cable guide according to claim 1, wherein the guide part is shaped so that it does not interfere with a member attached to a side surface of the drawer.

3. A cable guide according to claim 1, wherein the drawer has a side surface and the guide part has an attachment portion attached to the side surface of the drawer, the attachment portion having a notch.

4. A cable guide according to claim 3, wherein the notch is formed into the attachment portion to extend toward the front of the drawer.

5. A cable guide according to claim 1, wherein the guide part has a curved surface portion from the first end to the second end.

6. A cable guide according to claim 1, wherein the body of the drawer has a top and a side, the guide part is attached to the side of the body, and the front extends above the top of the body.

7. A drawer device, comprising:

a drawer having a front and a body, the front having a lip extending beyond the body; and a guide part having first and second ends, the first end being toward the front of the drawer and the first end having an increased height to extend further beyond the body of the drawer than the second end, the guide part becoming progressively shorter from the first end to the second end so that a cable draped over the drawer is pushed away from the body of the drawer as the drawer is closed.

8. A drawer device according to claim 7, wherein the drawer and the guide part are formed of resin.

9. A drawer device according to claim 7, wherein the guide part is shaped so that it does not interfere with a member attached to a side surface of the drawer.

10. A drawer device according to claim 7, wherein the drawer has a side surface and the guide part has an attachment portion attached to the side surface of the drawer, the attachment portion having a notch.

11. A drawer device according to claim 10, wherein the notch is formed into the attachment portion to extend toward the front of the drawer.

12. A drawer device according to claim 7, wherein the guide part has a curved surface portion from the first end to the second end.

13. A drawer device according to claim 7, wherein the body of the drawer has a top and a side, the guide part is attached to the side of the body, the front extends above the top of the body; and the guide part has an increased width where the guide part extends beyond the body of the drawer, the increased width allowing the guide part to overlay a portion of the top of the body.

14. A terminal device, comprising:

a casing;

a drawer moveable between open and closed positions into and out of the casing, respectively, the drawer having a front and a body, the front having a lip extending beyond the body; and a guide part attached to the side of the drawer, the guide part having first and second ends, the first end being toward the front of the drawer and the first end extending further beyond the body of the drawer than the second end, the guide part becoming progressively thinner from the first end to the second end so that a cable draped over the drawer is pushed away from the body of the drawer as the drawer is closed.

15. A terminal device according to claim 14, further comprising:

a hand held scanner; and a cable connecting the hand held scanner and the casing.

16. A terminal device according to claim 15, further comprising a scanner storage area formed on a surface of the casing, the scanner storage area including an area recessed below the surface of the casing or a wall raised above the surface of the casing.

17. A terminal device according to claim 14, wherein the drawer and the guide part are formed of resin.

18. A terminal device according to claim 14, wherein the guide part is shaped so that it does not interfere with a member attached to a side surface of the drawer.

19. A terminal device according to claim 14, wherein the drawer has a side surface and the guide part has an attachment portion attached to the side surface of the drawer, the attachment portion having a notch.

20. A terminal device according to claim 19, wherein the notch is formed into the attachment portion to extend toward the front of the drawer.

21. A terminal device according to claim 14, wherein the guide part has a curved surface portion from the first end to the second end.

22. A terminal device according to claim 14, wherein the body of the drawer has a top and a side, the guide part is attached to the side of the body, the front extends above the top of the body, and the guide part has an increased width where the guide part extends beyond the body of the drawer, the increased width allowing the guide part to overlay a portion of the top of the body.

* * * * *